US006598324B1

(12) United States Patent
Tsuji

(10) Patent No.: US 6,598,324 B1
(45) Date of Patent: Jul. 29, 2003

(54) BOWLING SHOES HAVING CUSTOMIZABLE GROUND ENGAGEMENT

(75) Inventor: Tatsuo Tsuji, Tokyo (JP)

(73) Assignee: American Bowling Services, Inc., Tokyo (JP)

( * ) Notice: Subject to any disclaimer, the term of this patent is extended or adjusted under 35 U.S.C. 154(b) by 0 days.

(21) Appl. No.: 09/511,274

(22) Filed: Feb. 23, 2000

(51) Int. Cl.[7] ..... A43B 5/00; A43C 13/00

(52) U.S. Cl. ..... 36/130; 36/15; 36/31; 36/134; 36/67 D; 36/100

(58) Field of Search ..... 36/36 R, 36 A, 36/36 B, 36 C, 130, 15, 114, 103, 71.5, 25 R, 135, 73, 31, 132, 136, 134, 96, 77 R, 100, 101, 67 D

(56) References Cited

U.S. PATENT DOCUMENTS

| | | | | | |
|---|---|---|---|---|---|
| 129,447 | A | * | 7/1872 | Wyman | 36/36 R |
| 634,998 | A | * | 10/1899 | Rumsey | 36/36 A |
| 745,393 | A | * | 12/1903 | Small | 36/36 A |
| 1,142,662 | A | * | 6/1915 | Blaney | 36/36 R |
| 1,548,025 | A | * | 8/1925 | Luca | 36/77 R |
| 1,702,800 | A | * | 2/1929 | Silvey | 36/127 |
| 1,967,334 | A | * | 7/1934 | Sothen | 36/77 R |
| 2,325,741 | A | * | 8/1943 | Chertok | 36/77 R |
| 2,640,283 | A | | 6/1953 | McCord | 36/25 |
| 3,027,661 | A | | 4/1962 | McCord | 36/30 |
| 3,041,746 | A | | 7/1962 | Rakus | 36/36 |
| 3,063,169 | A | | 11/1962 | Cortina | 36/36 |
| 3,068,592 | A | | 12/1962 | Antelo | 36/36 |
| 3,195,244 | A | | 7/1965 | Whitcas | 36/2.5 |
| 3,318,025 | A | | 5/1967 | Antelo | 36/30 |
| 3,478,447 | A | | 11/1969 | Gillead | 36/36 |
| 3,672,077 | A | | 6/1972 | Coles | 36/2.5 T |
| 3,982,336 | A | * | 9/1976 | Herro | 36/62 |
| 4,214,384 | A | | 7/1980 | Gonzalez R. | 36/42 |
| 4,351,120 | A | | 9/1982 | Dalebout | 36/117 |
| 4,377,042 | A | | 3/1983 | Bauer | 36/101 |
| 4,445,285 | A | | 5/1984 | Phillips | 36/25 R |
| 4,551,930 | A | | 11/1985 | Graham et al. | 36/30 R |
| 4,716,664 | A | | 1/1988 | Taylor | 36/114 |
| 5,410,821 | A | * | 5/1995 | Hilgendorf | 36/100 |
| 5,542,198 | A | | 8/1996 | Famolare | 36/130 |
| 5,956,870 | A | * | 9/1999 | Grossman et al. | 36/127 |
| 6,243,973 | B1 | * | 6/2001 | Lind | 36/130 |
| 6,311,415 | B1 | * | 11/2001 | Lind | 36/130 |

FOREIGN PATENT DOCUMENTS

| | | |
|---|---|---|
| EP | 0 510 384 | 10/1992 |
| GB | 23401 | of 1906 |
| GB | 302111 | 12/1928 |
| JP | 7-50961 | 4/1995 |

OTHER PUBLICATIONS

Bowling Shoes, Pro–Am, ABS Athletic Products '98–'99, published Apr. 1998 (two sheets).

Shoes Pro–Am; ABS '96–'97; published Apr. 1996 (two sheets).

* cited by examiner

*Primary Examiner*—J. Mohandesi
(74) *Attorney, Agent, or Firm*—Morgan, Lewis & Bockius

(57) ABSTRACT

A bowling shoe construction having various options for adjustment with removable and replaceable slide parts to attach to the tread surface of a slide shoe. The slide parts can attach interchangeably using hook and pile loop fasteners. A kick shoe includes an interchangeable kick part covering the toe area. The kick part can be attached using adhesives or hook and pile loop fasteners.

29 Claims, 6 Drawing Sheets

BOWLING SHOES HAVING CUSTOMIZABLE GROUND ENGAGEMENT

BACKGROUND OF INVENTION

This invention relates to shoes used by participants in the sport of bowling, and more particularly to bowling shoes that allow participants to customize the ground engagement properties of their shoes.

Each bowler has a unique style that they use during their approach to a bowling lane and during their ball release motion. Moreover, the bowling lanes and approaches are not uniformly conditioned. Thus, bowlers require bowling shoes that can be adjusted to accommodate their particular style and the various surface conditions that can be encountered.

As is known, when a bowler approaches a bowling lane and goes through the throwing motion, a first one of the bowler's feet performs a sliding function and a second one of the bowler's feet performs a kicking function. For a right-handed bowler, the left-foot performs the slide function and the right-foot performs the kicking function. During the sliding motion, the heel edge of the slide shoe is stressed when the heel touches the approach. Then, as the sliding motion continues, the stress moves from the heel edge to the heel corner. The durations of the stress on the heel edge and on the heel corner are different for every bowler. For example, the transition to stress on the heel corner occurs more quickly for a bowler sliding a longer distance than for a bowler sliding a shorter distance, and therefore the stress on the heel edge lasts for a shorter time.

One disadvantage of conventional bowling shoes is that a bowler must have many pairs of the conventional bowling shoes in order to be properly prepared for the widely varying approach conditions that are likely to be encountered. Another disadvantage is that conventional bowling shoes are obtained as identical pairs, albeit oppositely configured for the right-foot and the left-foot. Consequently, the ground engaging surface that is common to each shoe of a conventional pair cannot provide optimum performance for the different functions performed by each foot.

SUMMARY OF THE INVENTION

The present invention is directed to a bowling shoe that has various options for adjustment or customization. Particularly, the shoe features removable and replaceable slide parts that attach to the tread surface of the sole, and heel edge and heel corner parts that attach to the heel of the shoe. The removable and replaceable slide parts and heel parts can be attached with interlocking hook and pile loop fasteners, by adhesives, or by other known fastening techniques that facilitate interchangeablity. The present invention is also directed to a matched pair of shoes wherein one shoe is intended to be used by a bowler as the "slide shoe," and is combined with a "kick shoe" on the opposite foot.

The present invention provides ground engaging footwear to be worn concurrently by a biped having a right-foot and a left-foot. The footwear comprises a first shoe adapted to be received on a first one of the right-foot and the left-foot, the first shoe having a first sole, a first heel, and a first set of interchangeable ground engaging features on at least one of the first sole and the first heel; and a second shoe adapted to be received on a second one of the right-foot and the left-foot, the second shoe having a second sole, a second heel, and a second set of interchangeable ground engaging features on at least one of the second sole and the second heel. The first set of features differs from the second set of features.

The present invention also provides a pair of shoes for bowling. The pair of shoes comprises a slide shoe and a kick shoe. The slide shoe includes a first sole and a first heel fixedly attached to the first sole, a frame overlying and being fixedly attached to the first sole, the frame and a portion of the first sole having substantially congruent respective outer perimeters, the frame defining a central aperture, and an interchangeable slide pad being inset within and substantially occluding the central aperture. The kick shoe includes a second sole having a ground engaging face and a lateral edge extending from an outer boundary of the face, and an interchangeable kick part enveloping the face and the edge at a toe portion of the second sole.

The present invention further provides a slide shoe for a pair of bowling shoes. The slide shoe comprises a sole and a heel fixedly attached to the sole; a frame overlying and being fixedly attached to the sole, the frame and a portion of the sole having substantially congruent respective outer perimeters, the frame defining a central aperture; and an interchangeable slide pad being inset within and substantially occluding the central aperture, the slide pad including at least one cleat arrangement received in a corresponding hole defined by the slide pad.

The present invention yet further provides a kick shoe for a pair of bowling shoes. The kick shoe comprises a sole having a ground engaging face and a lateral edge extending from an outer boundary of the face, and an interchangeable kick part enveloping the face and the edge at a toe portion of the sole.

The present invention additionally provides a method of customizing ground engagement of a pair of bowling shoes. The method comprises providing a sliding shoe including a first sole and a first heel fixedly attached to the first sole, and a frame overlying and being fixedly attached to the first sole, the frame and a portion of the first sole having substantially congruent respective outer perimeters, the frame defining a central aperture; inserting within the central aperture a selected one of a set of interchangeable slide pads, the selected slide pad substantially occluding the central aperture and having a first selected ground engaging coefficient of friction relative to the frame; providing a kick shoe including a second sole having a ground engaging face and a lateral edge extending from an outer boundary of the face; and applying to a toe portion of the second sole a selected one of a set of interchangeable kick parts, the selected kick part enveloping the face and the edge at the toe portion of the second sole and having a second selected ground engaging coefficient of friction relative to the second sole.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT(S)

Figure 1A:
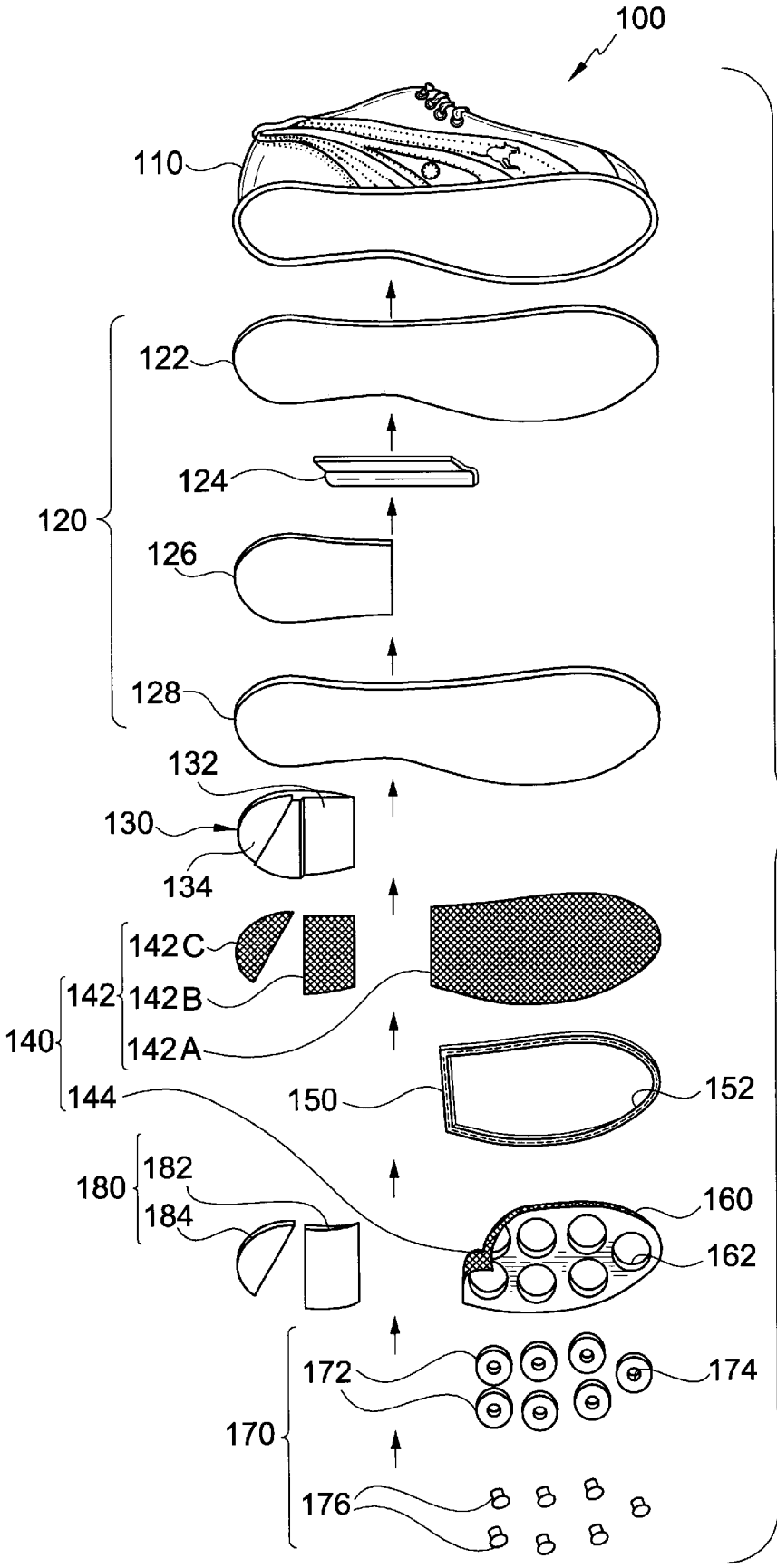
FIG. 1A is an exploded view showing the construction of a slide shoe according to the present invention.
Figure 1B:
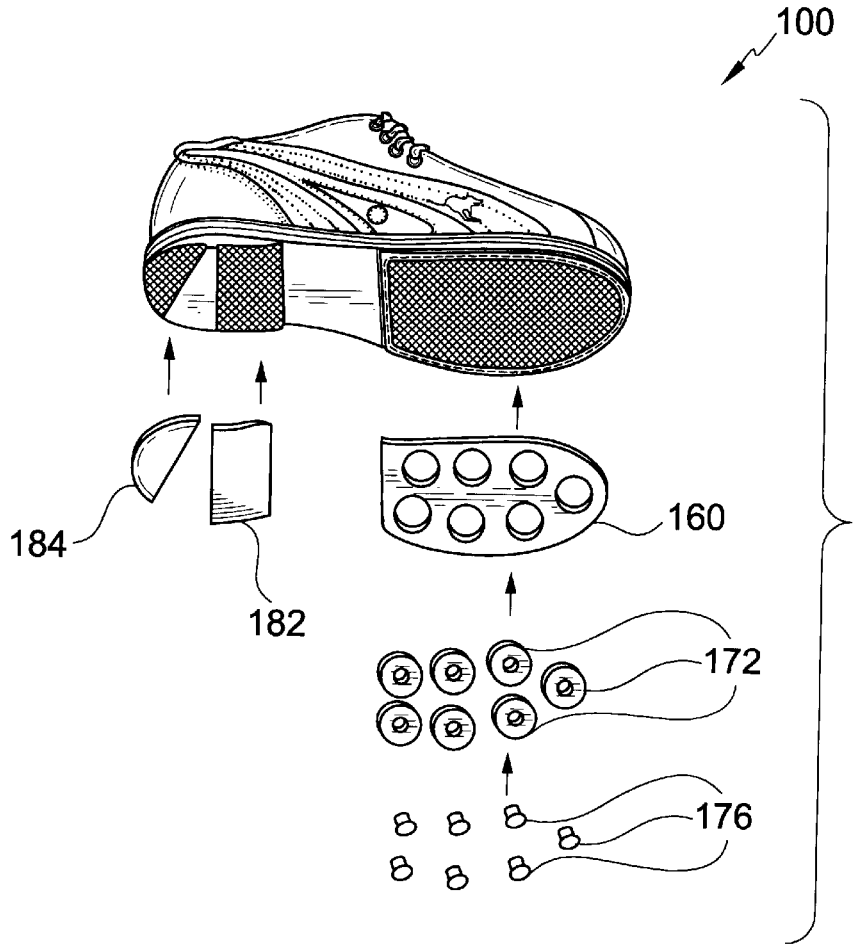
FIG. 1B is an exploded view showing the interchangeable features of the slide shoe shown in FIG. 1A.
Figure 1C:
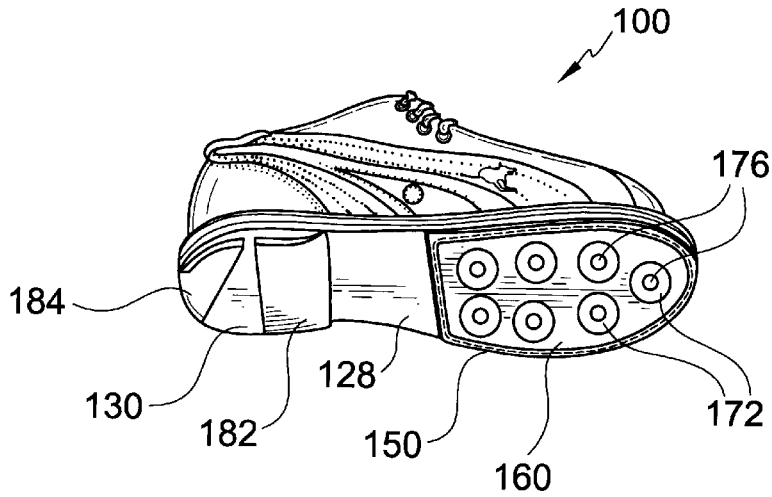
FIG. 1C is a perspective view showing the slide shoe shown in FIGS. 1A and 1B.

Referring to FIGS. 1A–1C, a bowling slide shoe 100 includes an upper 110 and a sole 120. The upper 110 can be made from numerous materials, including nylon, leather, canvas, etc. The sole 120 can be an assembly of a non-woven inner-sole 122, a reinforcing shank 124, a wedge 126, and a mid-sole 128. The wedge 126 and mid-sole 128 can be formed of a foamed, resilient, cushioning-type material, such as ethylene vinyl acetate (EVA), polyurethene (PU), phylan, Neoprene, Vinyl Nitrile, Styrene-Butadiene Rubber (SBR), Polyethylene (PE), ethyl vinyl acetate (EVA), ethylene propylene terpolymer (EPT), EPT/PE/Butyl Rubber, Neoprene/EPT/SBR, epichlorohydrin (ECH), and nitrile (NBR). The upper 110 and the sole 120 can be assembled according to conventional techniques.

A heel 130, which can be formed of rubber, is fixed to the bottom of the sole 120 by any conventional technique. The heel 130 can include one or more recesses. For example, a rectangular recess 132 can be formed that extends rearward from the arch portion of the sole 120, and a wedge-shaped recess 134 can be formed at the outer-rearmost corner of the heel 130.

A fastening system 140 secures interchangeable parts with respect to the sole 120 and the heel 130. The fastening system can include first parts 142 cooperatively engaging second parts 144, such as hooks interlockingly engaging pile loops. The fastening system can also include adhesives and other known techniques that enable a first body to be releasably retained with respect to a second body. The first parts 142 can include a piece 142A fixedly attached to the portion of the sole 120 and extending from the toe portion of the sole 120 to the arched portion of the sole 120, a piece 142B fixedly attached in the rectangular recess 132, and a piece 142C fixedly attached in the wedge-shaped recess 134.

A frame 150 is sewn about the perimeter of the sole 120 extending from the toe of the sole 120 to the arched portion of the sole 120. The frame 150 is made of a smooth material with a relatively low coefficient of friction, and is sewn on top of the fastener hooks piece 142A. The face of the frame 150 that confronts the sole 120 is covered with pile loops, such that the hook and pile loop fastening system would generally retain the frame 150 with respect to the sole 120 of the slide shoe 100 even if it the sole 120 and the frame 150 were not sewn together.

Of course, either the hooks or the pile loops can be fixedly attached to either the sole 120 or the frame 150. Thus, hooks can alternatively be fixedly attached to the face of the frame 150 confronting the sole 120, and the piece 142A can include pile loops covering the portion of the sole 120 extending from the toe of the sole 120 to the arched portion of the sole 120.

Within the frame 150, a slide pad 160 can be interchangeably placed onto the sole 120 of the slide shoe 100. A set of slide pads 160 can be made of several different materials, each having a different coefficient of friction. The slide pad 160 extends to each border of the frame 160, i.e., the slide pad 160 occludes a central aperture 152 defined by the frame 150. Thus, the frame 150 inhibits sliding movement of the slide pad 160 with respect to the sole 120. The face of the slide pad 160 that confronts the sole 120 is covered with pile loops, such that a hook and pile loop fastening system 140 retains the slide pad 160 with respect to the sole 120 of the slide shoe 100. However, the slide pad 160 can be removed from the sole 120 by breaking the hook and pile loop interlocking connection. Although the slide pad 160 can be removed by the user when desired, and can be replaced with different slide pads 160, it is designed to be retained on the sole 120 during wear and usage.

The slide pad 160 can define a plurality of holes 162 (seven circular holes are shown) that can be located approximately symmetrically about the slide pad 160. Within these holes, the user can affix cleat arrangements 170. Possible cleat arrangements 170 can include annular cleats 172 that each define a respective central opening 174. Different sets of annular cleats 172 can each have a surface material with a different coefficient of friction. Likewise, the user can affix cleats 176 which generally occlude the central opening 174 of a corresponding annular cleat 172. Different sets of cleats 176 also can each have a surface material with different coefficients of friction. Both the annular cleats 172 and the cleats 176 can be removably attached to the sole 120 via the fastening system 140. Although the holes 162, annular cleats 172, central openings 174, and cleats 176 have been illustrated as being circular in shape, all other shapes that are capable of mutually interacting are also acceptable.

Interchanging ones of the sliding pad 160, annular cleats 172, and cleats 174 allows a bowler to adjust the coefficient of friction for different portions of the sole 120. Thus, a bowler can customize the slide shoe 100 to facilitate a desired amount of sliding motion, regardless of the bowler's particular gait, stance, style, or the amount and type of lane conditioning at a particular bowling facility.

The heel 130 of the slide shoe 100 receives interchangeable attachments 180 including a rectangular heel edge part 182 and a wedge-shaped heel corner part 184, which are configured to be cooperatively received in the recesses 132 and 134, respectively. The faces of the heel parts 182,184 that confront the heel 130 have pile loops (not shown) that cooperatively interlock with the hook pieces 142B and 142C, respectively.

Of course, either the hooks or the pile loops can be fixedly attached to either the sole 120 or the cleat arrangements 170. Thus, hooks can alternatively be fixedly attached to the face of the cleat arrangements 170 confronting the sole 120, and the piece 142A can include pile loops covering the portion of the sole 120 extending from the toe of the sole 120 to the arched portion of the sole 120.

Figure 4:
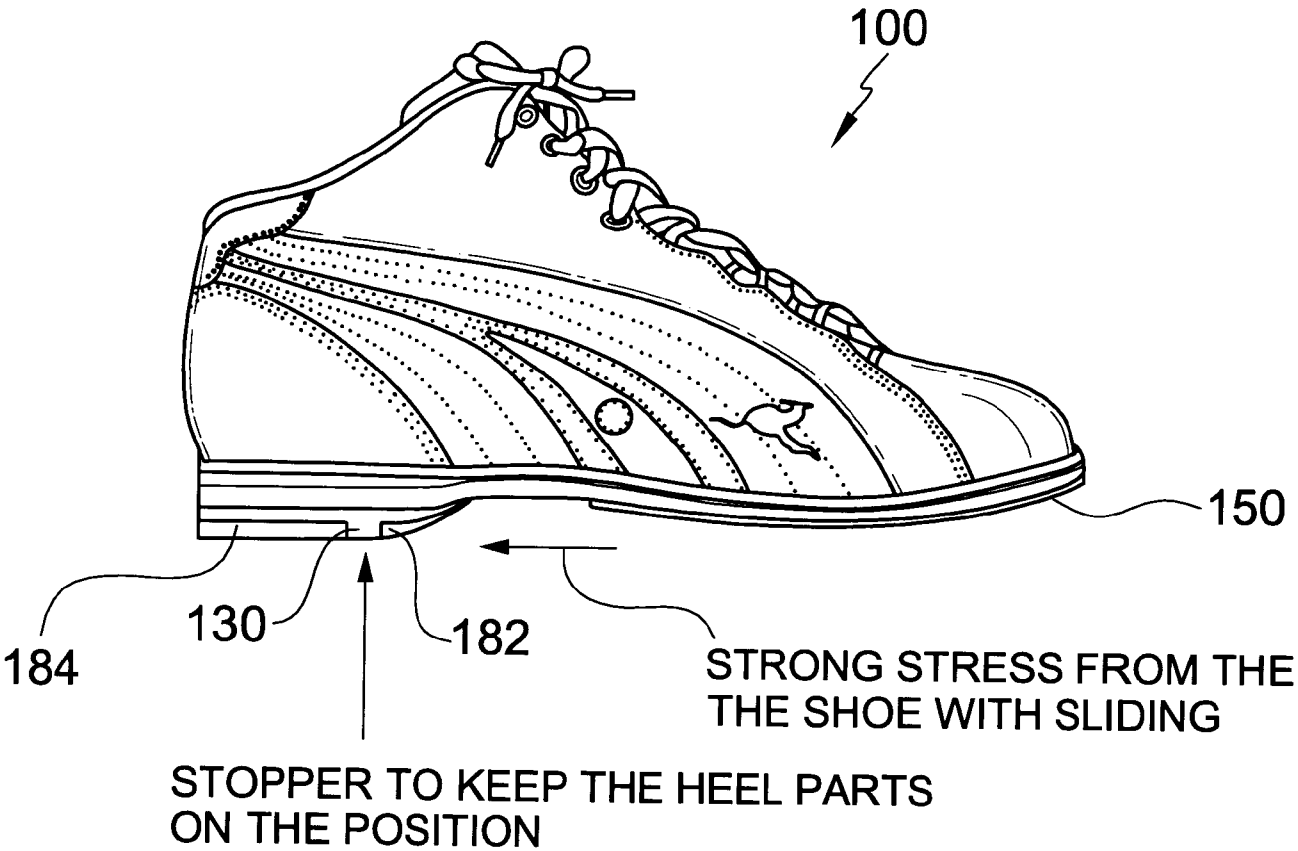
FIG. 4 is an explanatory diagram illustrating the forces acting on the heel of the slide shoe shown in FIGS. 1A–1C.

Referring also to FIG. 4, the sliding stresses due to ground engagement are different for every bowler. However, the frame 150 according to the present invention maintains the sliding pad 160 in the proper position with respect to the sole 120, regardless of the level of stress due to sliding engagement with the ground. Additionally, the heel parts 182,184 enable a bowler to adjust the sliding stress caused on the heel 130 of the slide shoe 100 as the bowler throws a bowling ball.

To provide different coefficients of friction and to adjust the sliding stresses according to the present invention, different ones of the interchangeable slide pads 160, annular cleats 172, cleats 176, heel edge parts 182, and heel corner parts 184 can be selected from a group of materials comprising rubber, TEFLON, felt, chrome leather, back skin, and deer skin.

Figure 2A:
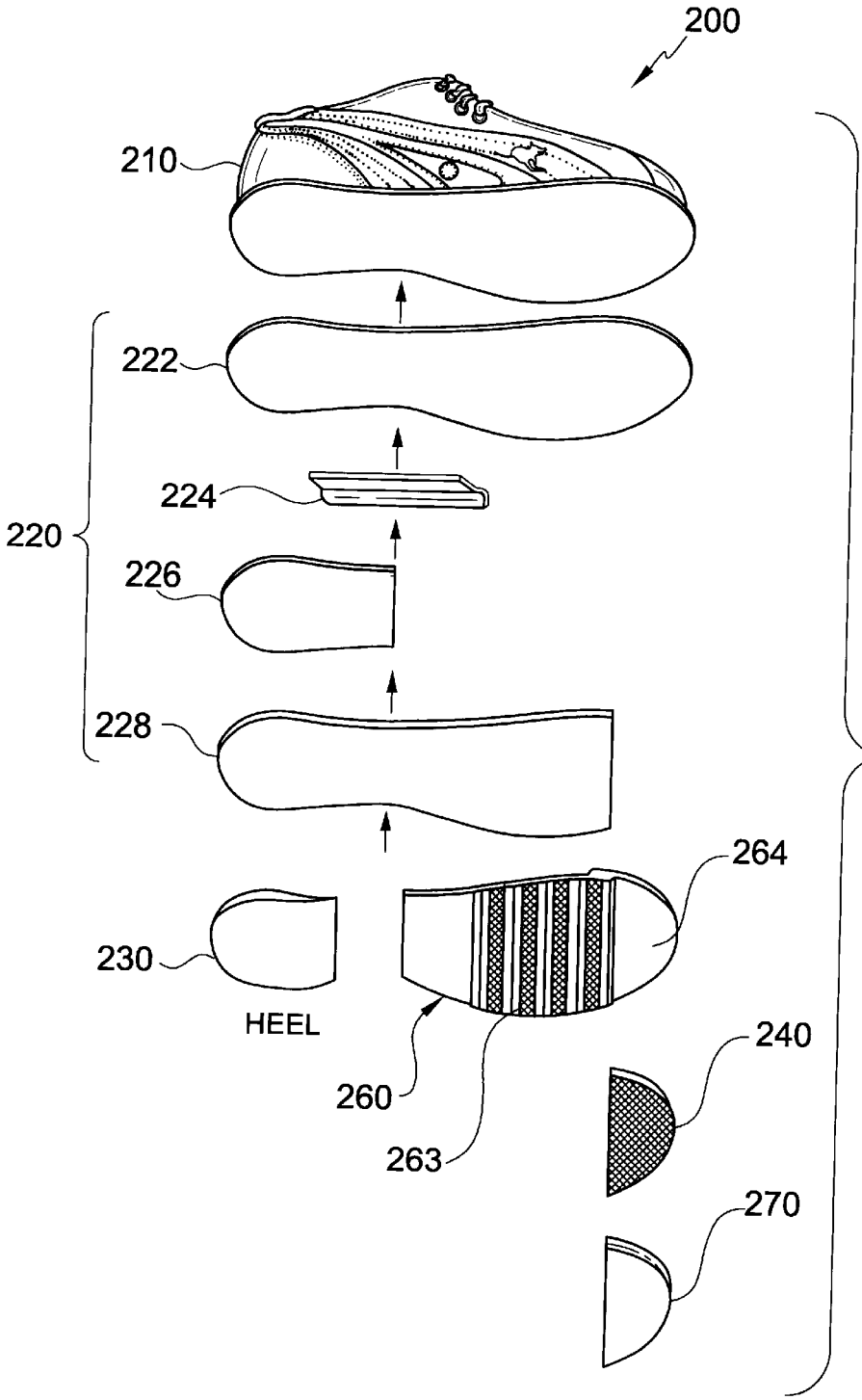
FIG. 2A is an exploded view showing the construction of a kick shoe according to the present invention.
Figure 2B:
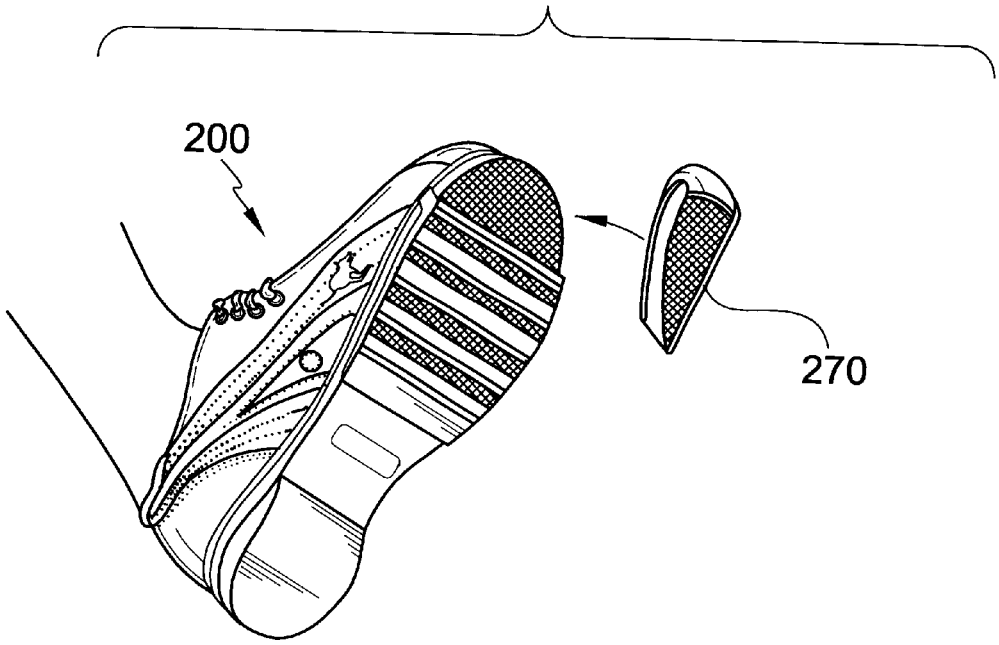
FIG. 2B is an exploded view showing the interchangeable features of the kick shoe shown in FIG. 2A.
Figure 2C:
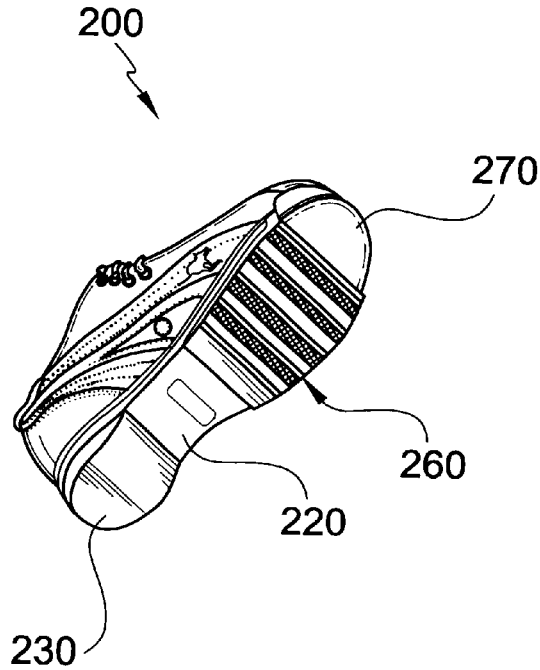
FIG. 2C is a perspective view showing the kick shoe shown in FIGS. 2A and 2B.

FIGS. 2A–2C show a bowling kick shoe 200 that is worn on the opposite foot from the slide shoe 100. The kick shoe 200 includes an upper 210 and a sole 220. The upper 210 can be made from numerous materials, including nylon, leather, canvas, etc. The sole 220 can be an assembly of a non-woven inner-sole 222, a reinforcing shank 224, a wedge 226, and a mid-sole 228. The wedge 226 and mid-sole 228 can be formed of a foamed, resilient, cushioning-type material, such as ethylene vinyl acetate (EVA), polyurethene (PU), phylan, Neoprene, Vinyl Nitrile, Styrene-Butadiene Rubber (SBR), Polyethylene (PE), ethyl vinyl acetate (EVA), ethylene propylene terpolymer (EPT), EPT/PE/ButylRubber, Neoprene/EPT/SBR, epichlorohydrin (ECH), and nitrile (NBR). A heel 230, which can be formed of rubber, is fixed to the bottom of the sole 220. The upper 210, sole 220, and the heel 230 can be assembled according to conventional techniques.

An out-sole 260 is fixedly attached to the sole 220 by conventional techniques. The out-sole 260 provides a tread 262 of any desired shape, depth, and pattern. The out-sole 260 can include one or more recesses. For example, a recess 264 can be formed at the toe of the out-sole 260.

A fastening system 240 provides a means of securing interchangeable parts with respect to the out-sole 260. The fastening system 240 can include hooks interlockingly engaging pile loops, adhesives, and other known techniques that enable a first body to be releasably retained with respect to a second body.

The fastening system 240 secures an interchangeable kick part 270 with respect to the recess 264 at the toe portion of the kick shoe 200. The kick part 270 can envelope portions of the bottom, top, and lateral edge (i.e., the generally upright side surface) areas of the sole 210 and out-sole 260.

Figure 3:
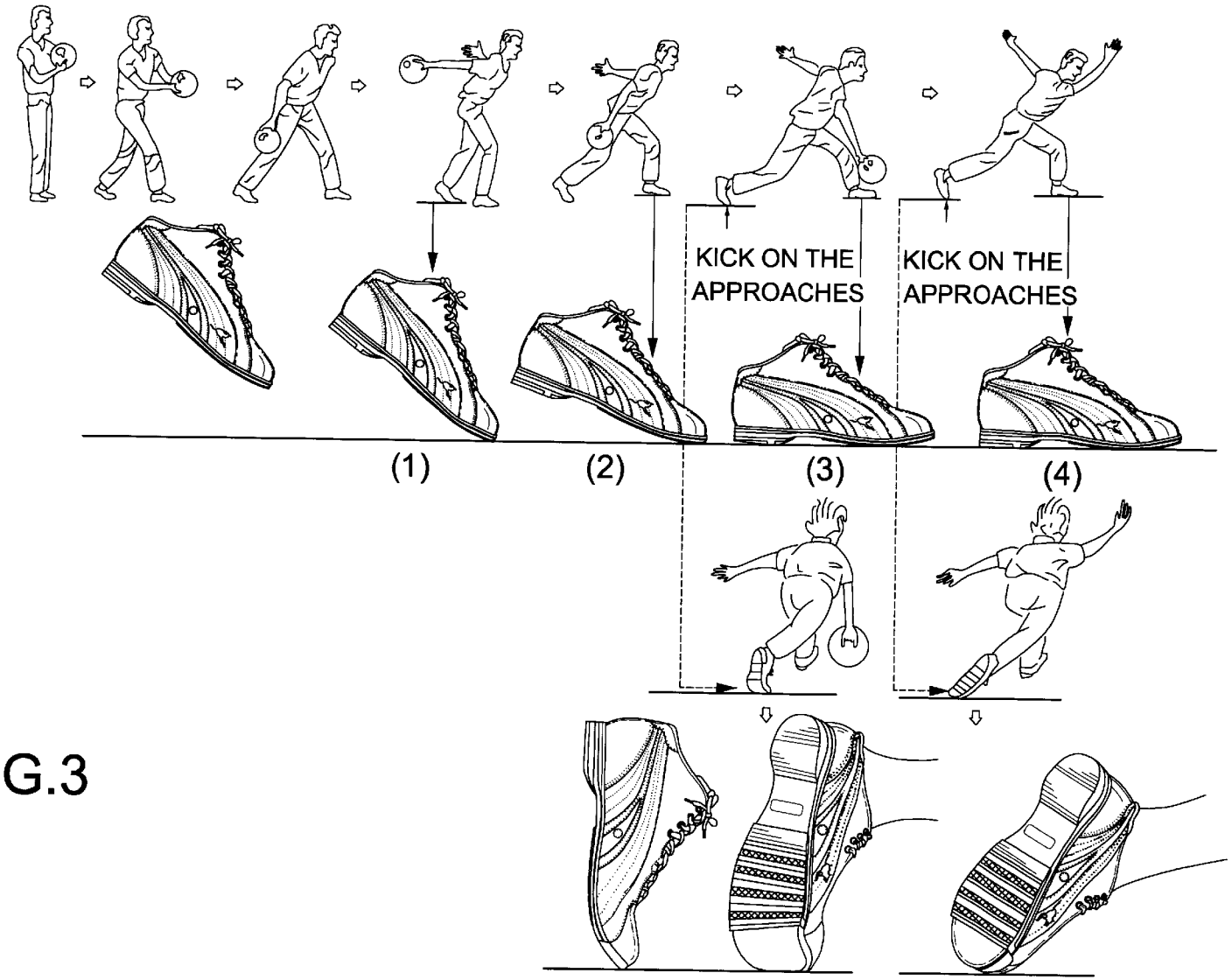
FIG. 3 is an explanatory diagram illustrating the motions of a bowler approaching a bowling lane.

Referring also to FIG. 3, when a bowler goes into a throwing motion during an approach to the lane, the bowler performs a strong kicking motion with the kick shoe 200. This causes a strong friction engagement on the toe of the kick shoe 200, which can cause the kick shoe 200 to prematurely wear. Therefore, the present invention provides a replaceable toe area portion by using interchangeable kick parts 270.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A pair of shoes for bowling, comprising:

a slide shoe including:

a first sole and a first heel fixedly attached to the first sole, a frame overlying and being fixedly attached to the first sole, the frame and a portion of the first sole having substantially congruent respective outer perimeters, the frame defining a central aperture, and an interchangeable slide pad being inset within and substantially occluding the central aperture, the slide pad including at least one cleat arrangement received in a corresponding hole defined by the slide pad, and the at least one cleat arrangement including an annular cleat having a central opening and a cleat, the cleat occluding the central opening and a combination of the annular cleat and the cleat occluding the corresponding hole; and a kick shoe including:

a second sole having a ground engaging face and a lateral edge extending from an outer boundary of the face, and an interchangeable kick part enveloping the face and the edge at a toe portion of the second sole.

2. The pair of shoes according to claim 1, wherein the slide shoe further includes:

a first fastening system interposed between and interchangeably attaching the slide pad to the first sole.

3. The pair of shoes according to claim 2, wherein the first fastening system includes a first one of a hook fastener and a pile fastener fixedly attached to the slide pad, and a second one of the hook fastener and the pile fastener fixedly attached to the first sole.

4. The pair of shoes according to claim 2, wherein the first fastening system is interposed between the frame and the first sole.

5. The pair of shoes according to claim 4, wherein the frame is fixedly attached to the first sole by sewing.

6. The pair of shoes according to claim 1, wherein the first heel includes at least one of an interchangeable heel corner part and an interchangeable heel edge part, the heel corner part being attachably received in a first depression of the first heel and the heel edge part being attachably received in a second depression of the first heel.

7. The pair of shoes according to claim 6, wherein the slide shoe further includes:

a second fastening system interposed between and interchangeably attaching the heel corner part to the first heel.

8. The pair of shoes according to claim 7, wherein the second fastening system includes a first one of a hook fastener and a pile fastener fixedly attached to the heel corner part, and a second one of the hook fastener and the pile fastener fixedly attached in the first depression.

9. The pair of shoes according to claim 6, wherein the slide shoe further includes:

a third fastening system interposed between and interchangeably attaching the heel edge part to the first heel.

10. The pair of shoes according to claim 9, wherein the third fastening system includes a first one of a hook fastener and a pile fastener fixedly attached to the heel edge part, and a second one of the hook fastener and the pile fastener fixedly attached in the second depression.

11. The pair of shoes according to claim 6, wherein at least two of the first heel, the heel corner part, and the heel edge part have ground engaging surfaces with different coefficients of friction.

12. The pair of shoes according to claim 1, wherein at least two of the slide pad, the annular cleat, and the cleat have ground engaging surfaces with different coefficients of friction.

13. The pair of shoes according to claim 1, wherein the kick shoe further includes:

a fourth fastening system interposed between and interchangeably attaching the kick part to the second sole.

14. The pair of shoes according to claim 13, wherein the fourth fastening system includes a first one of a hook fastener and a pile fastener fixedly attached to the kick part, and a second one of the hook fastener and the pile fastener fixedly attached to the second sole.

15. The pair of shoes according to claim 13, wherein the fourth fastening system includes an adhesive.

16. A slide shoe for a pair of bowling shoes, the slide shoe comprising:

a sole and a heel fixedly attached to the sole;

a frame overlying and being fixedly attached to the sole, the frame and a portion of the sole having substantially congruent respective outer perimeters, the frame defining a central aperture; and an interchangeable slide pad being inset within and substantially occluding the central aperture, the slide pad including at least one cleat arrangement received in a corresponding hole defined by the slide pad, and the at least one cleat arrangement including an annular cleat having a central opening and a cleat, the cleat occluding the central opening and a combination of the annular cleat and the cleat occluding the corresponding hole.

17. The slide shoe according to claim 16, wherein at least two of the slide pad, the annular cleat, and the cleat have ground engaging surfaces with different coefficients of friction.

18. The slide shoe according to claim 16, further comprising:

a first fastening system interposed between and interchangeably attaching the slide pad to the sole.

19. The slide shoe according to claim 8, wherein the first fastening system includes a first one of a hook fastener and a pile fastener fixedly attached to the slide pad, and a second one of the hook fastener and the pile fastener fixedly attached to the sole.

20. The slide shoe according to claim 18, wherein the first fastening system is interposed between the frame and the sole.

21. The slide shoe according to claim 20, wherein the frame is fixedly attached to the sole by sewing.

22. The slide shoe according to claim 16, further comprising:

at least one of an interchangeable heel corner part and an interchangeable heel edge part, the heel corner part being attachably received in a first depression of the heel and the heel edge part being attachably received in a second depression of the heel.

23. The slide shoe according to claim 22, further comprising:

a second fastening system interposed between and interchangeably attaching the heel corner part to the heel.

24. The slide shoe according to claim 23, wherein the second fastening system includes a first one of a hook fastener and a pile fastener fixedly attached to the heel corner part, and a second one of the hook fastener and the pile fastener fixedly attached in the first depression.

25. The slide shoe according to claim 22, further comprising:

a third fastening system interposed between and interchangeably attaching the heel edge part to the heel.

26. The slide shoe according to claim 25, wherein the third fastening system includes a first one of a hook fastener and a pile fastener fixedly attached to the heel edge part, and a second one of the hook fastener and the pile fastener fixedly attached in the second depression.

27. The slide shoe according to claim 22, wherein at least two of the heel, the heel corner part, and the heel edge part have ground engaging surfaces with different coefficients of friction.

28. A method for customizing ground engagement of a pair of bowling shoes, the method comprising:

providing a sliding shoe including:

a first sole and a first heel fixedly attached to the first sole, and a frame overlying and being fixedly attached to the first sole, the frame and a portion of the first sole having substantially congruent respective outer perimeters, the frame defining a central aperture;

inserting within the central aperture a selected one of a set of interchangeable slide pads, the selected slide pad substantially occluding the central aperture and having a first selected ground engaging coefficient of friction relative to the frame;

inserting in a corresponding hole defined by the selected slide pad a selected one of a set of interchangeable cleat arrangements;

inserting a selected one of a set of an annular cleats having a central opening and inserting a selected one of a set of cleats occluding the central opening, the selected annular cleat having a second selected ground engaging coefficient of friction relative to the selected slide pad and the selected cleat having a third selected ground engaging coefficient of friction relative to the selected annular cleat;

providing a kick shoe including a second sole having a ground engaging face and a lateral edge extending from an outer boundary of the face; and applying to a toe portion of the second sole a selected one of a set of interchangeable kick parts, the selected kick part enveloping the face and the edge at the toe portion of the second sole and having a fourth selected ground engaging coefficient of friction relative to the second sole.

29. The method according to claim 28, further comprising:

attaching to the first heel selected respective ones of a set of heel corners and a set of heel edges, the selected heel corner having a fifth selected ground engaging coefficient of friction relative to the first heel and the selected heel edge having a sixth selected ground engaging coefficient of friction relative to the first heel.

* * * * *